US011555382B2

(12) United States Patent
Halvorsen et al.

(10) Patent No.: US 11,555,382 B2
(45) Date of Patent: Jan. 17, 2023

(54) SUBSEA FIELD ARCHITECTURE

(71) Applicant: FMC Technologies, Inc., Houston, TX (US)

(72) Inventors: Tore Halvorsen, Kongsberg (NO); Paulo Couto, Rio de Janeiro (BR); Alain Marion, Rueil Malmaison (FR)

( * ) Notice: Subject to any disclaimer, the term of this patent is extended or adjusted under 35 U.S.C. 154(b) by 0 days.

(21) Appl. No.: 17/542,277

(22) Filed: Dec. 3, 2021

(65) Prior Publication Data

US 2022/0090472 A1 Mar. 24, 2022

Related U.S. Application Data

(63) Continuation of application No. 16/319,269, filed as application No. PCT/US2017/049978 on Sep. 1, 2017, now abandoned.

(60) Provisional application No. 62/383,199, filed on Sep. 2, 2016.

(51) Int. Cl.

| | |
|---|---|
| ***E21B 33/035*** | (2006.01) |
| ***E21B 36/00*** | (2006.01) |
| ***E21B 43/017*** | (2006.01) |
| ***E21B 43/00*** | (2006.01) |
| ***E21B 15/00*** | (2006.01) |
| ***E21B 43/013*** | (2006.01) |

(52) U.S. Cl.

CPC ..... *E21B 43/017* (2013.01); *E21B 15/00* (2013.01); *E21B 36/00* (2013.01); *E21B 36/005* (2013.01); *E21B 43/00* (2013.01); *E21B 43/013* (2013.01); *E21B 33/035* (2013.01)

(58) Field of Classification Search

CPC ..... E21B 33/035; E21B 36/00; E21B 36/005; E21B 43/00; E21B 43/013; E21B 43/017; E21B 43/0175

See application file for complete search history.

(56) References Cited

U.S. PATENT DOCUMENTS

| | | | | |
|---|---|---|---|---|
| 6,102,077 A * | 8/2000 | Legallais | F16L 11/22 | 138/148 |
| 7,219,740 B2 * | 5/2007 | Saucier | E21B 33/038 | 166/344 |
| 8,100,182 B2 * | 1/2012 | Smith | E21B 43/013 | 166/344 |
| 8,430,168 B2 * | 4/2013 | Goodall | F16L 1/26 | 166/344 |
| 8,720,581 B2 * | 5/2014 | Berg | E21B 43/013 | 166/344 |

(Continued)

FOREIGN PATENT DOCUMENTS

WO WO-9118182 A * 11/1991 ..... E21B 33/0355

*Primary Examiner* — Matthew R Buck

(74) *Attorney, Agent, or Firm* — Henry C. Query, Jr.

(57) ABSTRACT

A subsea hydrocarbon production field includes a number of first subsea christmas trees, a first manifold, a number of first flexible flowline jumpers, each of which is connected between the first manifold and a corresponding first tree. Each first flowline jumper includes a first flow conduit and a number of first umbilical lines, and each first flowline jumper includes a first end which is removably connected to a corresponding first tree by a first multibore hub and connector arrangement and a second end which is removably connected to the first manifold by a second multibore hub and connector arrangement.

18 Claims, 8 Drawing Sheets

(56) References Cited

U.S. PATENT DOCUMENTS

| | | | | |
|---|---|---|---|---|
| 9,004,177 | B2 * | 4/2015 | Hatton | E21B 43/017 166/345 |
| 2003/0056954 | A1 * | 3/2003 | Headworth | E21B 17/18 166/57 |
| 2003/0145998 | A1 * | 8/2003 | Langford | B01D 17/045 166/368 |
| 2007/0227740 | A1 * | 10/2007 | Fontenette | E21B 33/038 166/344 |
| 2008/0210432 | A1 * | 9/2008 | Crossley | E21B 43/017 166/357 |
| 2009/0314495 | A1 * | 12/2009 | Schott, III | E21B 43/017 166/366 |
| 2010/0089126 | A1 * | 4/2010 | Sweeney | E21B 33/0385 405/173 |
| 2017/0204704 | A1 * | 7/2017 | Sommerfield | E21B 41/04 |

* cited by examiner

SUBSEA FIELD ARCHITECTURE

This application is a continuation of U.S. patent application Ser. No. 16/319,269 filed on Jan. 18, 2019, which is a U.S. national stage filing of PCT Patent Application No. PCT/US2017/049978 filed on Sep. 1, 2017, which in turn is based on and claims priority from U.S. Provisional Patent Application No. 62/383,199 filed on Sep. 2, 2016.

The present disclosure is directed to a subsea oil or gas field. More particularly, the disclosure is directed to a subsea field which simpler, less costly and easier to install than prior art subsea fields.

BACKGROUND OF THE DISCLOSURE

Subsea hydrocarbon production fields typically comprise a plurality of christmas trees which are mounted on corresponding well bores. These trees may be arranged in more than one cluster, especially where the subterranean hydrocarbon formation extends over a substantial area. The trees in each cluster are often connected to a common manifold by respective flowline jumpers. In addition, the manifolds of the separate clusters may be connected together by corresponding flowlines. The well fluids produced by the several trees are commonly routed through their respective manifolds to a flowline end termination unit which in turn is connected to an offsite production and/or processing facility by a flowline.

The flowline jumpers used to connect the trees to their corresponding manifolds are usually rigid metal pipes. Accordingly, the flowline jumpers must be specifically designed to span the exact distance between a connection hub on the tree and a corresponding connection hub on the manifold. In addition, rigid flowline jumpers are relatively heavy, expensive to manufacture and difficult to handle, and they typically require special equipment to install.

Furthermore, in certain subsea fields a risk exists that hydrates may form in the flowlines. If this happens, the flow of well fluids to the offsite production and/or processing facility may be substantially diminished or even blocked. In order to ensure that the flow of well fluids will not be interrupted, many subsea hydrocarbon production fields are designed to have redundant flowlines. This involves using two flowlines between the several manifolds, between the manifolds and their corresponding flowline end termination units, and between the end termination units and the offsite production and/or processing facility. As may be appreciated, the use of redundant flowlines greatly increases the cost and time to construct the subsea field.

Each tree in the subsea field typically includes a number of electrically or hydraulically actuated valves for controlling the flow of well fluids through the tree. These valves are usually controlled by a subsea control module ("SCM") which is located on or adjacent the tree. Typically, the subsea control modules are in turn controlled by a control station located, e.g., on a surface vessel. The control station is normally connected to the SCM's through an umbilical, which typically includes a number of electrical data lines and hydraulic and/or electrical control lines. The umbilical is often connected to an umbilical termination head which in turn is connected to the several trees via corresponding flying leads. However, flying leads are difficult and time consuming to install and are subject to being tangled and damaged. If a flying lead becomes damaged, control of that tree is usually lost until the flying lead can be replaced.

SUMMARY OF THE DISCLOSURE

In accordance with the present disclosure, a subsea hydrocarbon production field is provided which comprises a number of first subsea christmas trees; a first manifold; and a number of first flexible flowline jumpers, each of which is connected between the first manifold and a corresponding first tree.

In accordance with one aspect of the disclosure, each first flowline jumper comprises a first flow conduit and a number of first umbilical lines.

In accordance with another aspect of the disclosure, the subsea hydrocarbon production field also includes a first flowline which is connected to the first manifold, the first flowline comprising a second flow conduit and a number of second umbilical lines. In this embodiment, the first flow conduits are connected through the first manifold to the second flow conduit and the first umbilical lines are connected through the first manifold to corresponding ones of the second umbilical lines.

In accordance with yet another aspect of the disclosure, the first flowline jumpers and/or the first flowline comprise means for heating a fluid in their respective flow conduits.

In accordance with a further aspect of the disclosure, the subsea hydrocarbon production field also includes a number of second subsea christmas trees; a second manifold; a number of second flexible flowline jumpers, each of which is connected between the second manifold and a corresponding second tree, and each of which comprises a third flow conduit and a number of third umbilical lines; and a second flowline which is connected between the first and second manifolds, the second flowline comprising a fourth flow conduit and a number of fourth umbilical lines. In this embodiment; the fourth flow conduit is connected through the first manifold to the second flow conduit, the fourth umbilical lines are connected through the first manifold to corresponding ones of the second umbilical lines, the third flow conduits are connected through the second manifold to the fourth flow conduit, and the third umbilical lines are connected through the second manifold to corresponding ones of the fourth umbilical lines.

In accordance with an aspect of the disclosure, the first and second flowlines may comprise respective sections of a single flowline.

In accordance with another aspect of the disclosure, the first flowline jumpers and/or the first flowline and/or the second flowline jumpers and/or the second flowline comprise means for heating a fluid in their respective flow conduits.

In accordance with yet another aspect of the disclosure, the subsea hydrocarbon production field further comprises a number of third subsea christmas trees; a third manifold; a number of third flexible flowline jumpers, each of which is connected between the third manifold and a corresponding third tree, and each of which comprises a fifth flow conduit and a number of fifth umbilical lines; and a third flowline which is connected between the second and third manifolds, the third flowline comprising a sixth flow conduit and a number of sixth umbilical lines. In this embodiment, the sixth flow conduit is connected through the second manifold to the fourth flow conduit, the sixth umbilical lines are connected through the second manifold to corresponding ones of the fourth umbilical lines, the fifth flow conduits are connected through the third manifold to the sixth flow conduit, and the fifth umbilical lines are connected through the third manifold to corresponding ones of the sixth umbilical lines.

In accordance with a further aspect of the disclosure, the first, second and third flowlines may comprise respective sections of a single flowline.

In accordance with another aspect of the disclosure, the first flowline jumpers and/or the first flowline and/or the second flowline jumpers and/or the second flowline and/or the third flowline jumpers and/or the third flowline comprise means for heating a fluid in their respective flow conduits.

In accordance with yet another aspect of the disclosure, at least one of said manifolds comprises a pipeline in-line manifold.

Thus it may be seen that the subsea hydrocarbon production field of the present disclosure addresses many of the issues experienced with prior art subsea fields by replacing the rigid flowline jumpers with flexible flowline jumpers, incorporating active heating elements into the flowlines to prevent the formation of hydrates and therefore obviate the need for redundant flowlines, and integrating the umbilical lines into the flowlines and flowline jumpers to thereby eliminate the need for flying leads.

These and other objects and advantages of the present disclosure will be made apparent from the following detailed description, with reference to the accompanying drawings. In the drawings, the same reference numbers may be used to denote similar components in the various embodiments.

DETAILED DESCRIPTION

Figure 1:
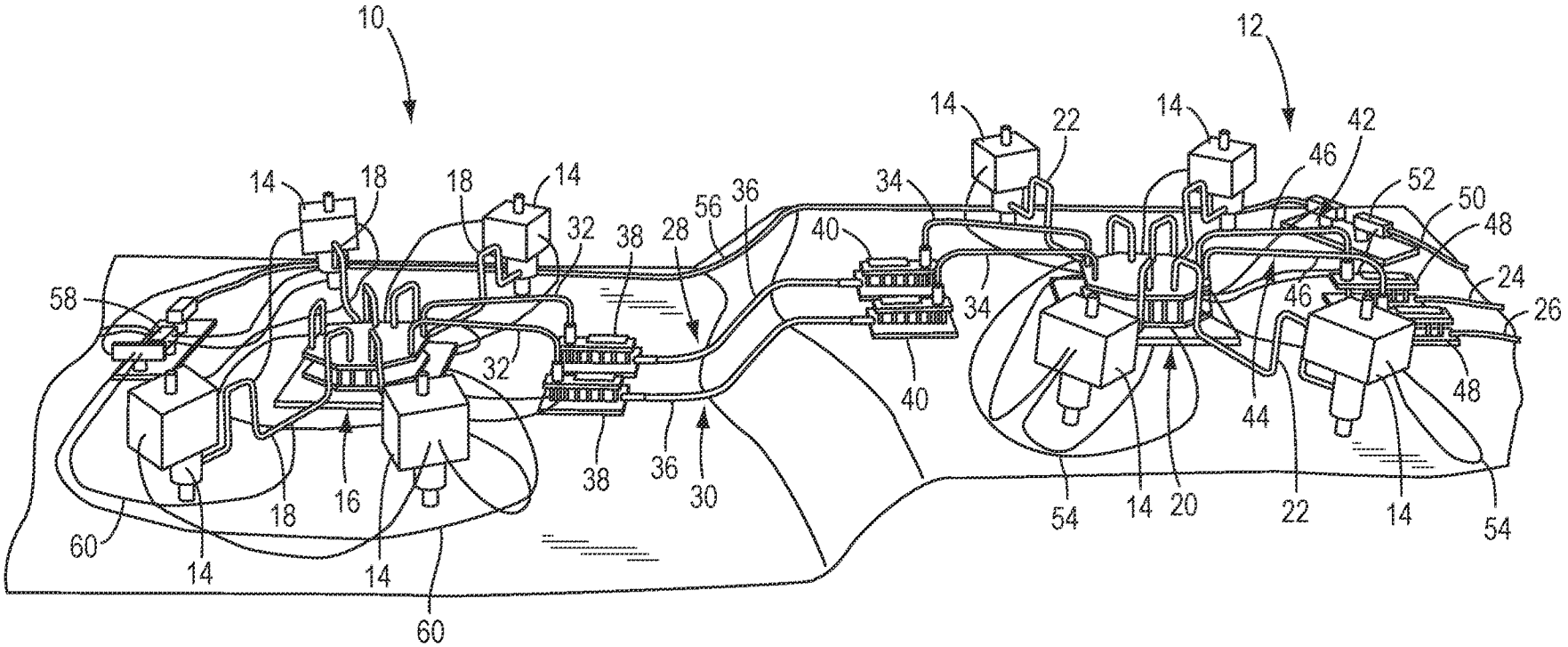
Fig. 1 (Prior Art)
FIG. 1 is a representation of a prior art subsea oil or gas field.

As background for the present disclosure, an example of a prior art subsea oil or gas field will be described with reference to FIG. 1. The prior art oil or gas field includes a plurality of subsea wells which are arranged into two sub-fields 10 and 12. As shown in FIG. 1, for example, each sub-field 10, 12 has four subsea wells. Each well comprises a wellhead on which is mounted a corresponding subsea christmas tree 14. Each tree 14 in the first sub-field 10 is connected to a first manifold 16 by a corresponding flowline jumper 18. Similarly, each tree 14 in the second sub-field 12 is connected to a second manifold 20 by a corresponding flowline jumper 22. The flowline jumpers 18, 22 are rigid pipes which must each be specifically designed to span the exact distance between a respective connection hub on the tree 14 and a corresponding connection hub on the manifold 16, 20.

The well fluids produced through the trees 14 are routed through the first and second manifolds 16, 20 and a pair of production flowlines 24, 26 to, e.g., a surface vessel (not shown). More specifically, the well fluids produced through the trees 14 in the first sub-field 10 are routed through the first manifold 16 to the second manifold 20 by a pair of intermediate flowline assemblies 28, 30. Each intermediate flowline assembly 28, 30 includes a first rigid flowline jumper 32 which is connected to the first manifold 16, a second rigid flowline jumper 34 which is connected to the second manifold 20, and a flexible flowline jumper 36 which is connected to the first flowline jumper 32 by a first flowline connection module 38 and to the second flowline jumper 34 by a second flowline connection module 40. From the second manifold 20, the well fluids produced by the trees 14 in the first sub-field 10 are combined with the well fluids produced by the trees in the second sub-field 12, and these fluids are conveyed through a pair of exit flowline assemblies 42, 44 to the production flowlines 24, 26. Each exit flowline assembly 42, 44 includes a rigid flowline jumper 46 having a first end which is connected to the second manifold 20 and a second end which is connected to a corresponding production flowline 24, 26 by a flowline connection module 48.

Each tree 14 typically includes a number of electrically or hydraulically actuated valves for controlling the flow of well fluids through the tree, a number of sensors for monitoring certain conditions of the well fluids, and a subsea control module ("SCM") for controlling the operation of the valves and collecting the data generated by the sensors. Each manifold 16, 20 may similarly include such valves, sensors and an SCM. The surface vessel communicates with the subsea field through an umbilical 50, which typically includes a number of electrical data lines and hydraulic and/or electrical control lines. In the prior art subsea field shown in FIG. 1, the umbilical 50 is connected to a first umbilical termination head 52 located in the second sub-field 12. The umbilical termination head 52 includes a number of electrical and hydraulic junctions to which the electrical data lines and the hydraulic and/or electrical control lines in the umbilical 50 are connected. Respective sets of these junctions are in turn connected to the manifold 20 and each tree 14 in the second sub-field 12 via corresponding flying leads 54. The first umbilical termination head 52 is also connected to an intermediate umbilical 56, which in turn is connected to a second umbilical termination head 58 located in the first sub-field 10. Similar to the first umbilical termination head 52, the second umbilical termination head 58 includes a number of electrical and hydraulic junctions to which the electrical data lines and the hydraulic and/or electrical control lines in the intermediate umbilical 56 are connected. Respective sets of these junctions are in turn connected to the manifold 16 and each tree 14 in the first sub-field 10 via corresponding flying leads 60.

As may be apparent from the foregoing description, the prior art subsea field depicted in FIG. 1 has several features which contribute to the overall cost and complexity of the field. First, the field employs three sets of multi-component flowlines assemblies for connecting the trees 14 and the manifolds 16, 20 to the surface vessel: the intermediate flowline assemblies 28, 30, the exit flowline assemblies 42, 44, and the production flowlines 24, 26. Although a single flowline assembly is often sufficient to convey the produced well fluids to the surface vessel, the subsea field includes a redundant flowline assembly to convey the produced well fluids to the surface vessel in the event the first flowline assembly becomes blocked by hydrates or wax deposits, which often form when the produced well fluids are cooled to below a certain temperature by the surrounding sea water. Also, the prior art subsea field of FIG. 1 includes multiple rigid flowline jumpers 18, 22 for connecting the trees 14 to their corresponding manifolds 16, 20. As discussed above, the flowline jumpers 18, 22 are rigid pipes which must be specifically designed. As such, they are costly to manufacture and time-consuming to install. What is more, the manifolds 16, 20 are relatively large, heavy components which must be made so in order to support the rigid flowline jumpers 18, 22, 32, 34, 46 and accommodate their corresponding connectors. Finally, the prior art subsea field shown in FIG. 1 employs a complicated arrangement for connecting the umbilical 50 to each of the trees 14 and the manifolds 16, 20. Not only are the flying leads 54, 60 difficult and time consuming to install, but they also are subject to becoming tangled and damaged.

The subsea field architecture of the present disclosure addresses many of the issues experienced with the prior art subsea field of FIG. 1 by replacing the rigid flowline jumpers with flexible flowline jumpers, minimizing the size and complexity of the trees and manifolds, integrating the umbilical lines into the flowline and flowline jumpers, and incorporating active heating elements into the flowline.

Figure 2:
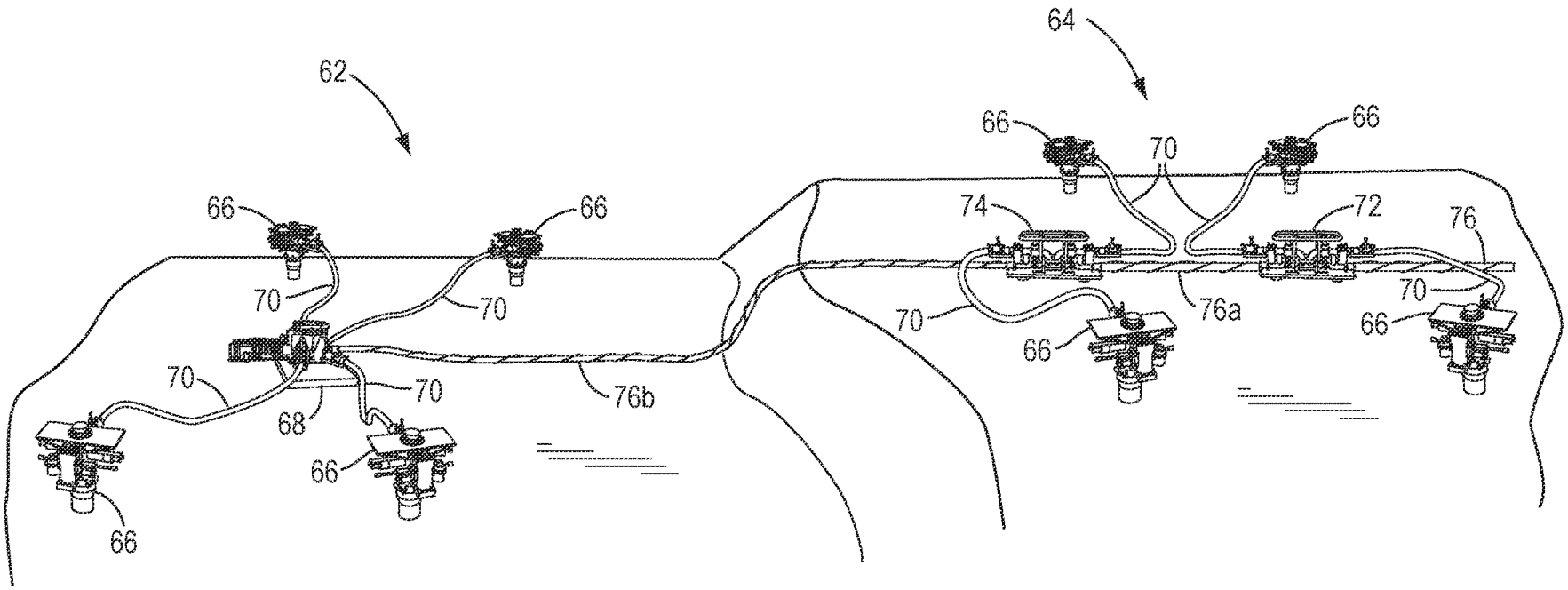
FIG. 2 is a representation of the improved subsea oil or gas field of the present disclosure.
Figure 3:
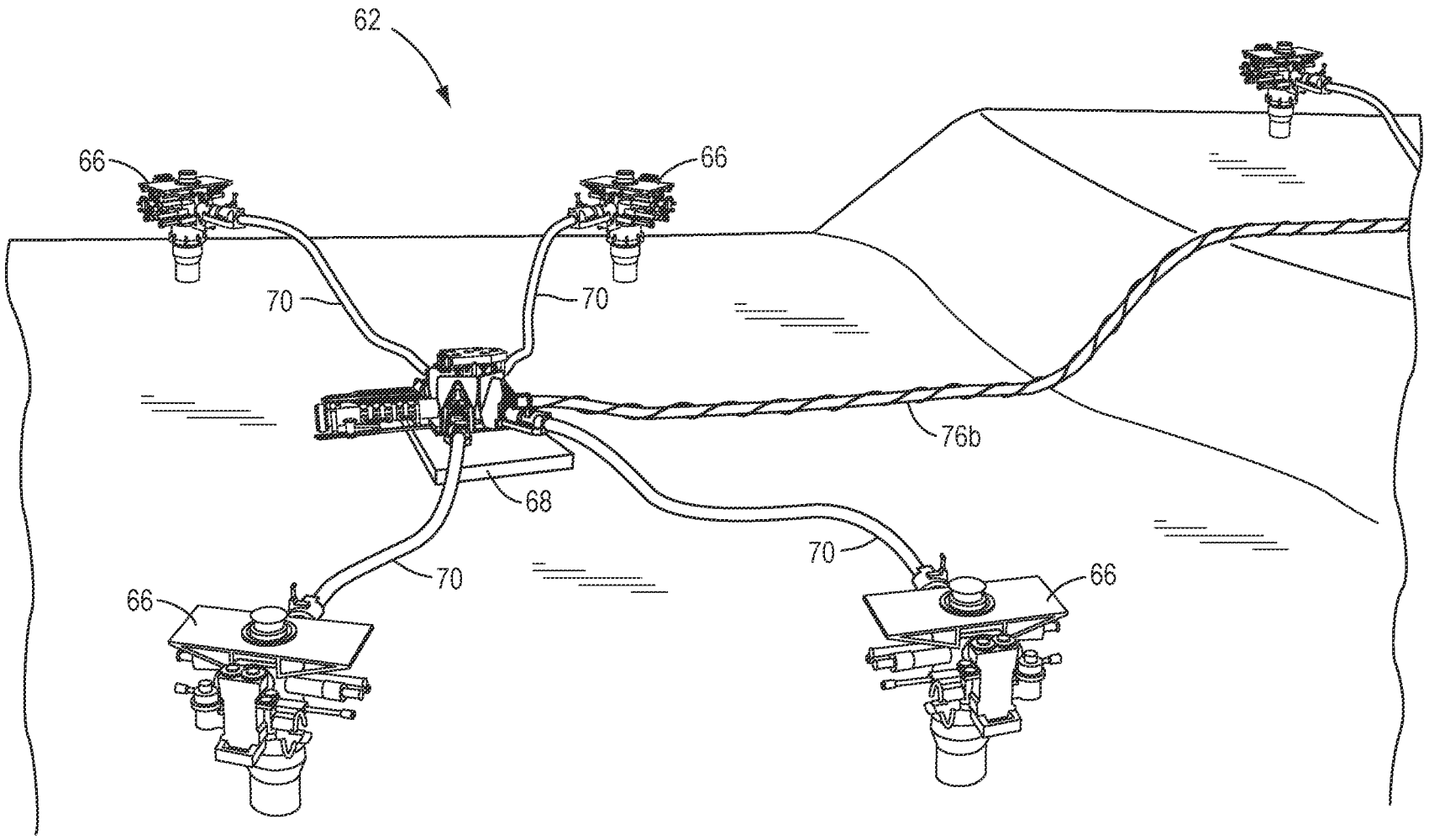
FIG. 3 is a representation of a first sub-field of the subsea field shown in FIG. 2.
Figure 4:
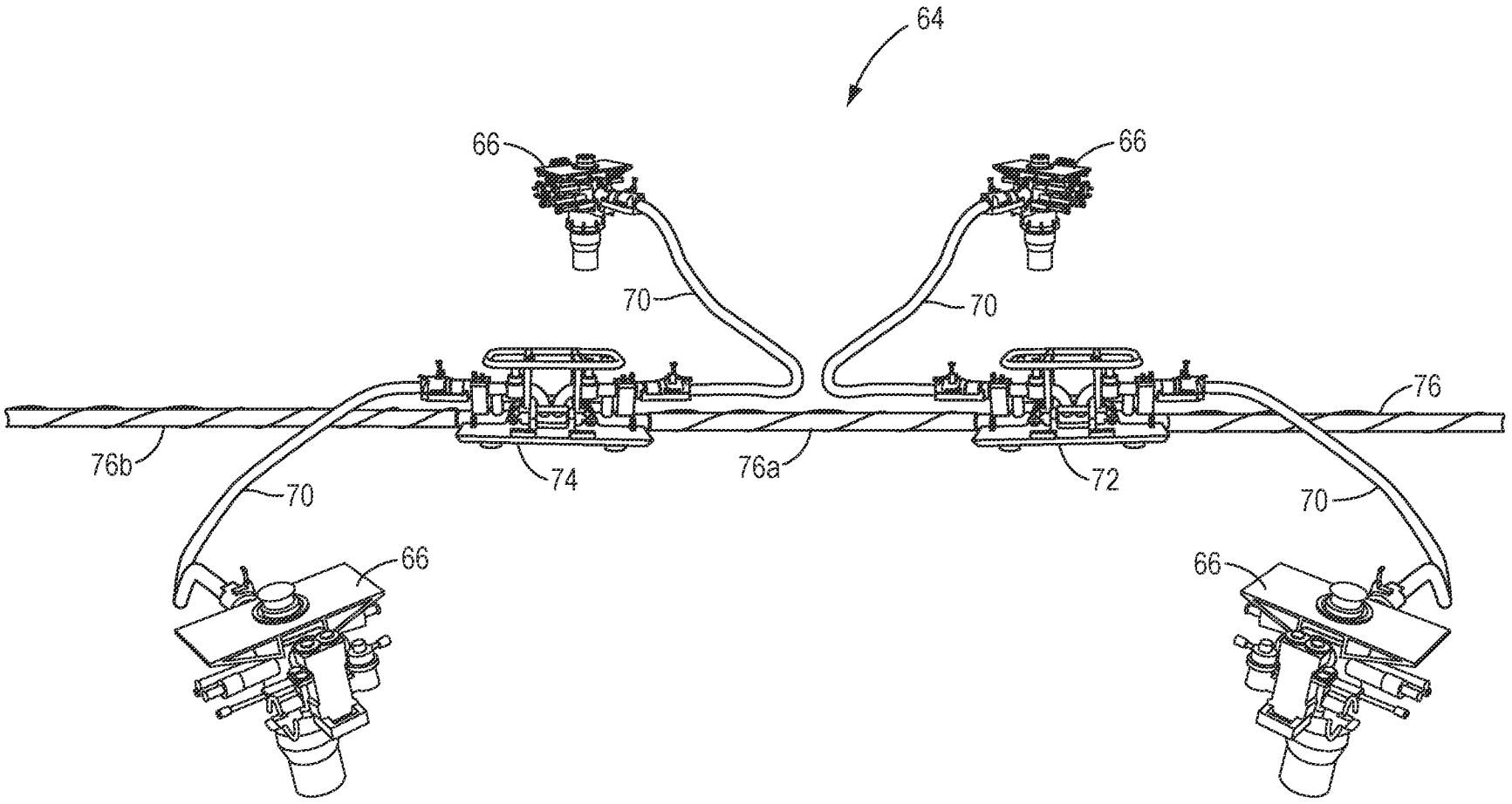
FIG. 4 is a representation of a second sub-field of the subsea oil/gas field shown in FIG. 2.

Referring to FIGS. 2-4, the subsea field of the present disclosure includes a plurality of subsea wells which are arranged in a number of sub-fields, for example a first sub-field 62 and a second subfield 64. Each subsea well includes a wellhead on which is mounted a subsea christmas tree 66. The first sub-field 62 includes four trees 66, each of which is connected to a manifold 68 via a flexible flowline jumper 70. The second sub-field 64 also includes four trees 66; however, instead of being connected to a manifold, two trees 66 are connected to a first tie-in module 72 by corresponding flowline jumpers 70 and two trees 66 are connected to a second tie-in module 74 by corresponding flowline jumpers 70.

In accordance with the present disclosure, the well fluids produced in the subsea field are conveyed to, e.g., a surface vessel through a single flexible flowline 76. In the specific, non-limiting embodiment of the disclosure shown in the drawings, the flowline 76 is connected the first tie-in module 72, which in turn is connected to the second tie-in module 74 by a first flowline extension 76*a*. The second tie-in module 74 is in turn connected to the manifold 68 by a second flowline extension 76*b*. Thus, the well fluids produced through the trees 66 in the first sub-field 62 are routed through the manifold 68 and the second flowline extension 76*b* to the first and second tie-in modules 72, 74, where they are combined with the well fluids produced through the trees 66 in the second sub-field 62, and these fluids are conveyed through the single flowline 76 to the surface vessel.

Figure 5:
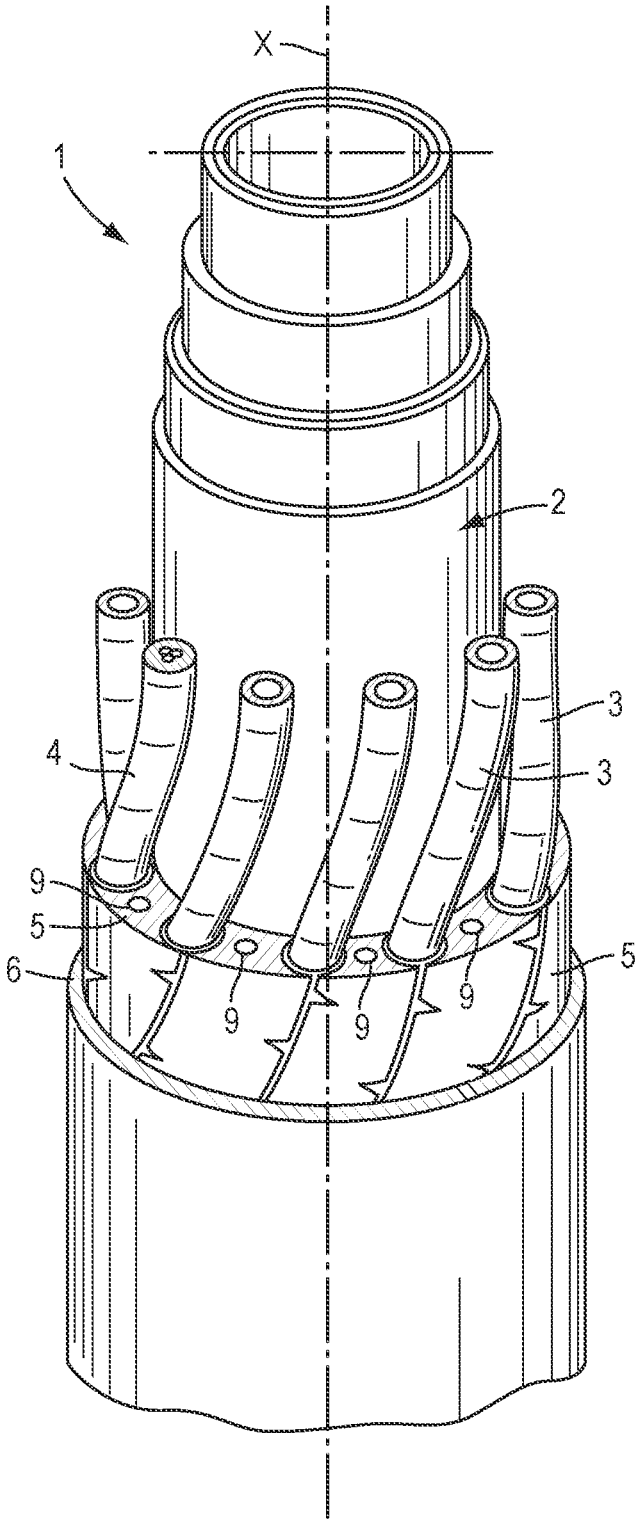
Fig. 5 (Prior Art)
FIG. 5 is a perspective view of the flexible pipeline disclosed in FIG. 3 of U.S. Pat. No. 6,102,077.

In a preferred embodiment of the disclosure, the flowline 76 is a multi-tube conduit which combines a production conduit or flowline and several umbilical lines in a single flexible pipeline. An example of such a flowline is described in U.S. Pat. No. 6,102,077, which is hereby incorporated herein by reference. As shown in FIG. 3 of that patent, the relevant portion of which is reproduced herein as FIG. 5, the flowline includes a central flexible conduit (2) for conveying hydrocarbons, several peripheral umbilical lines (3) for conveying, e.g., hydraulic fluid, and several electrical umbilical lines (4) for conveying electrical power and/or signals. Thus, the flowline 76 is able to both convey well fluids from the trees 66 to the vessel and transmit hydraulic and/or electric power, control and/or data signals from the vessel to the trees. In this manner, the subsea field of the present disclosure does not require a separate umbilical to communicate with and control the trees 66.

The flowline 76 also ideally includes an active heating arrangement, such as one or more trace heating cables, for maintaining the well fluids at a desired temperature and thereby prevent the formation of hydrates or wax deposits which could block the flow pipe. By eliminating the risk that the flowline will be blocked by hydrates or wax deposits, no need exists for a redundant second flowline, as in the prior art subsea field described above. A flexible flowline which includes both a production conduit and several umbilical lines, as well as an active heating arrangement, is the Integrated Production Bundle, or IPB™, manufactured by Technip of Paris, France.

In accordance with the present disclosure, the flowline jumpers 70 for connecting the trees 66 to the manifold 16 and the tie-in modules 72, 74 are similar to the flexible flowline 76 just described. Thus, the flowline jumpers 70 include a production conduit for conveying well fluids and a number of umbilical lines, such as hydraulic and/or electrical power, control and/or data umbilical lines, for controlling and communicating with the trees 66. By incorporating the umbilical lines into the flowline jumpers 70, the subsea field does not require flying leads to connect a separate umbilical to the trees. Also, the flexible flowline jumpers 70 eliminate the need for the rigid flowline jumpers of the prior art subsea field, which as discussed above must be specially designed and are difficult to install.

Figure 6:
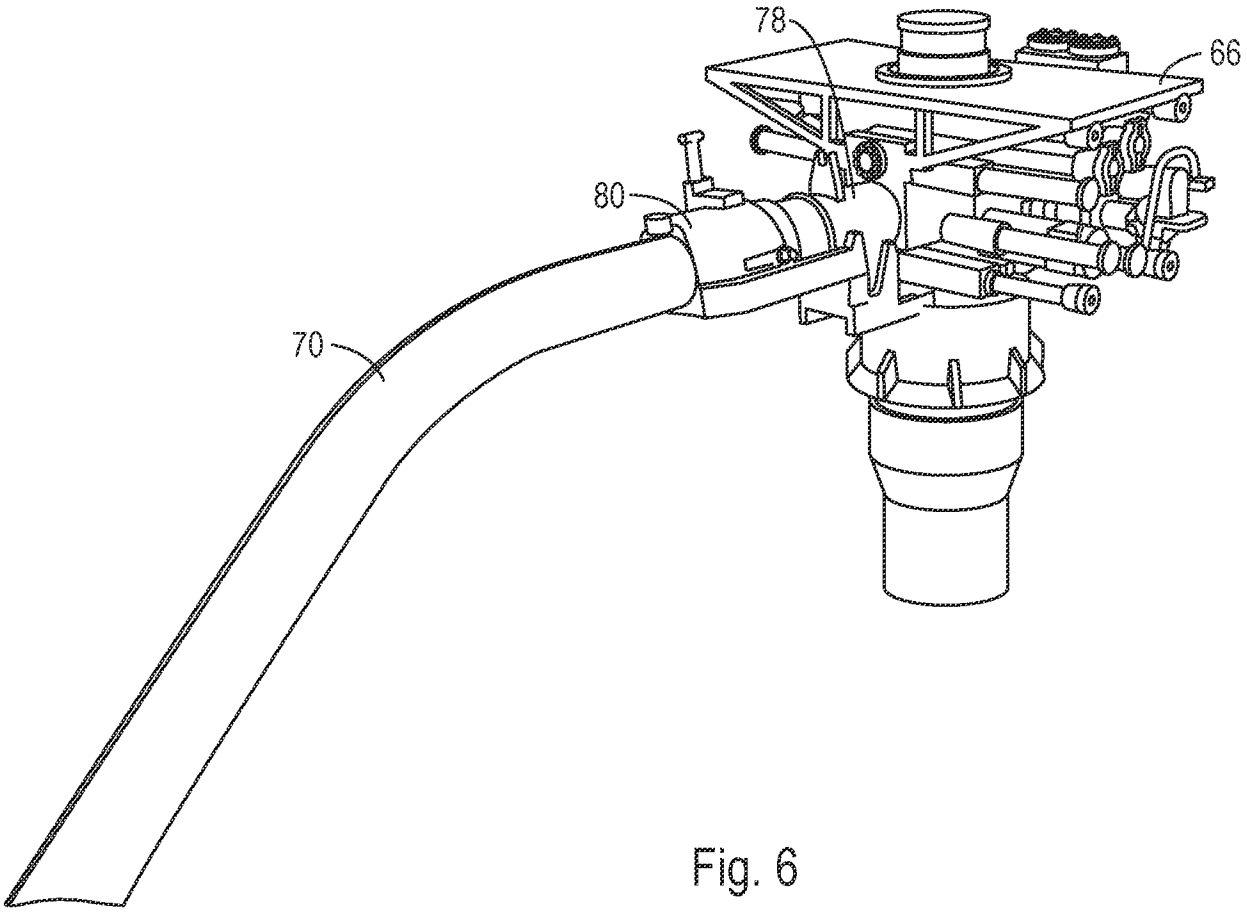
FIG. 6 is a representation of a subsea tree component of the subsea field shown in FIG. 2.

Although the subsea trees 66 may be any type of tree which is desired or required to be used for a particular application, they are preferably lighter and simpler in construction than conventional subsea trees. Referring also to FIG. 6, for example, the subsea trees 66 may comprise an ultra-compact tree of the type described in U.S. Provisional Patent Application No. 62/367,488 filed on Jul. 27, 2016, which was subsequently filed as International Patent Application No. PCT/US2017/043978 on Jul. 26, 2017, both of which are hereby incorporated herein by reference. The ultra-compact tree has a compact configuration which is both lighter and simpler to manufacture than conventional subsea trees. As such, the trees are less costly and can be installed with smaller surface vessels than are normally required.

As shown in FIG. 6, each tree 66 includes a multibore hub 78 to which a corresponding connector 80 on the end of the flowline jumper 70 is connected. Although not visible in FIG. 6, the multibore hub 78 includes a production bore and a number of tree line connectors, e.g., wetmate receptacles. Also, the end connector 80 includes a flowline bore which is configured to mate with the production bore in the multibore hub 78, and a number of end line connectors, e.g., wetmate probes, which are configured to mate with the wetmate receptacles in the multibore hub. The production bore in the multibore hub 78 is connected to the production bore in the tree 66, and the wetmate receptacles in the multibore hub are connected to corresponding hydraulic and/or electrical power, control and/or data lines in the tree (which may be referred to herein as tree transmission lines). Likewise, the flowline bore in the end connector 80 is connected to the production conduit in the flowline jumper 70, and the wetmate probes in the end connector are connected to corresponding hydraulic and/or electrical power, control and/or data umbilical lines in the flowline jumper. Thus, when the end connector 80 is connected to the multibore hub 78, the production conduit in the flowline jumper 70 will be connected to the production bore in the tree 66, and the hydraulic and/or electrical power, control and/or data umbilical lines in the flowline jumper will be connected to corresponding hydraulic and/or electrical power, control and/or data lines in the tree.

Figure 7:
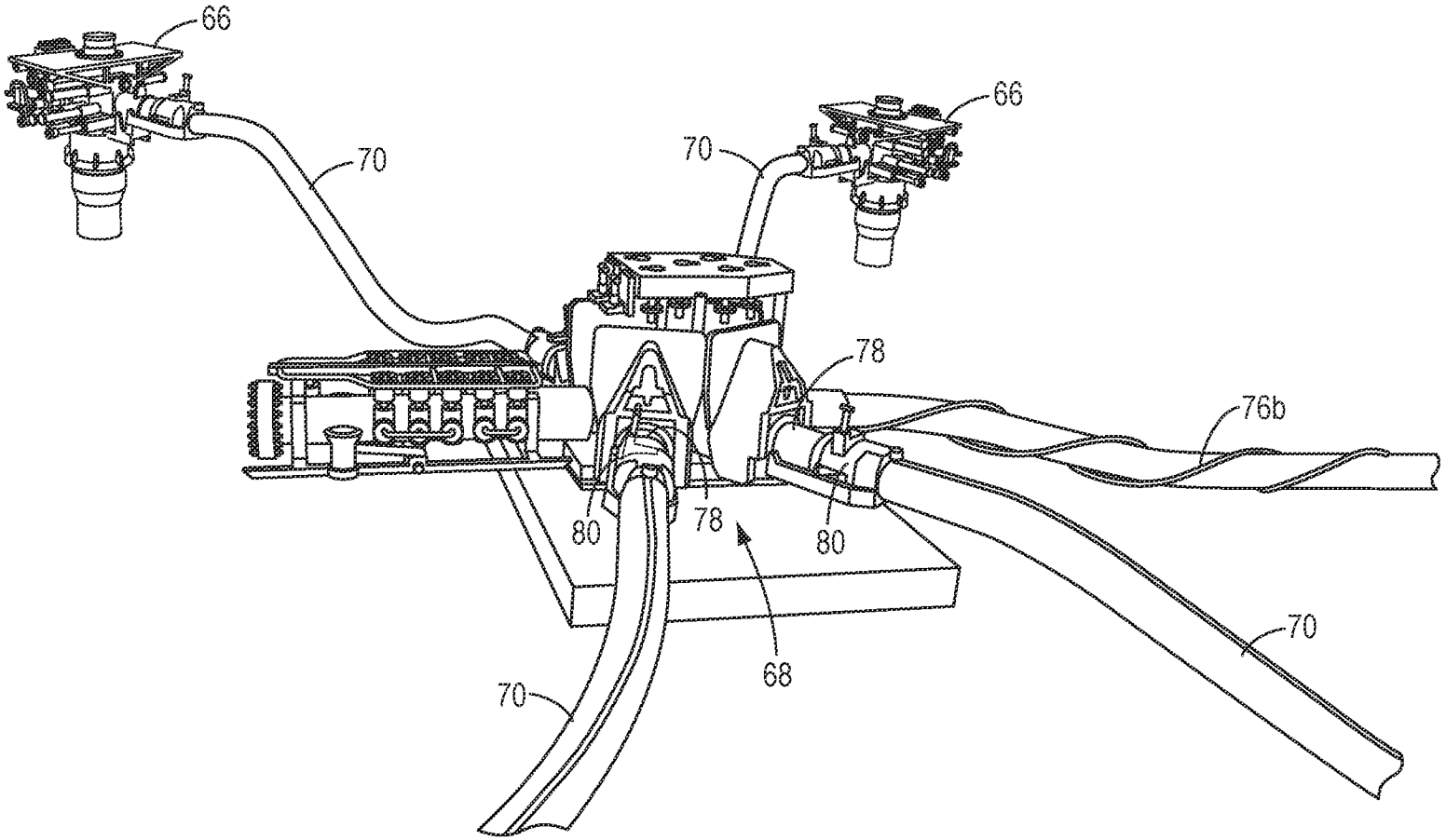
FIG. 7 is a representation of the manifold component of the subsea field shown in FIG. 2.

Referring also to FIG. 7, the manifold 68 is a relatively small, lightweight component which primarily serves to connect the second flowline extension 76*b* to the flowline jumpers 70 from the trees 66 in the first sub-field 62. An example of such a manifold is described in International Patent Application No. PCT/BR2015/050158 filed on Sep. 18, 2015, which was subsequently published under International Publication No. WO 2016/044910 A1 on Mar. 31, 2016, both of which are hereby incorporated herein by reference. The manifold 68 includes a five multibore hubs 78 to which corresponding connectors 80 on the ends of the flowline jumpers 70 and the flowline extension 76*b* are connected. The multibore hubs 78 and the end connectors may be similar to the multibore hub 78 and end connector 80 described above.

Figure 8:
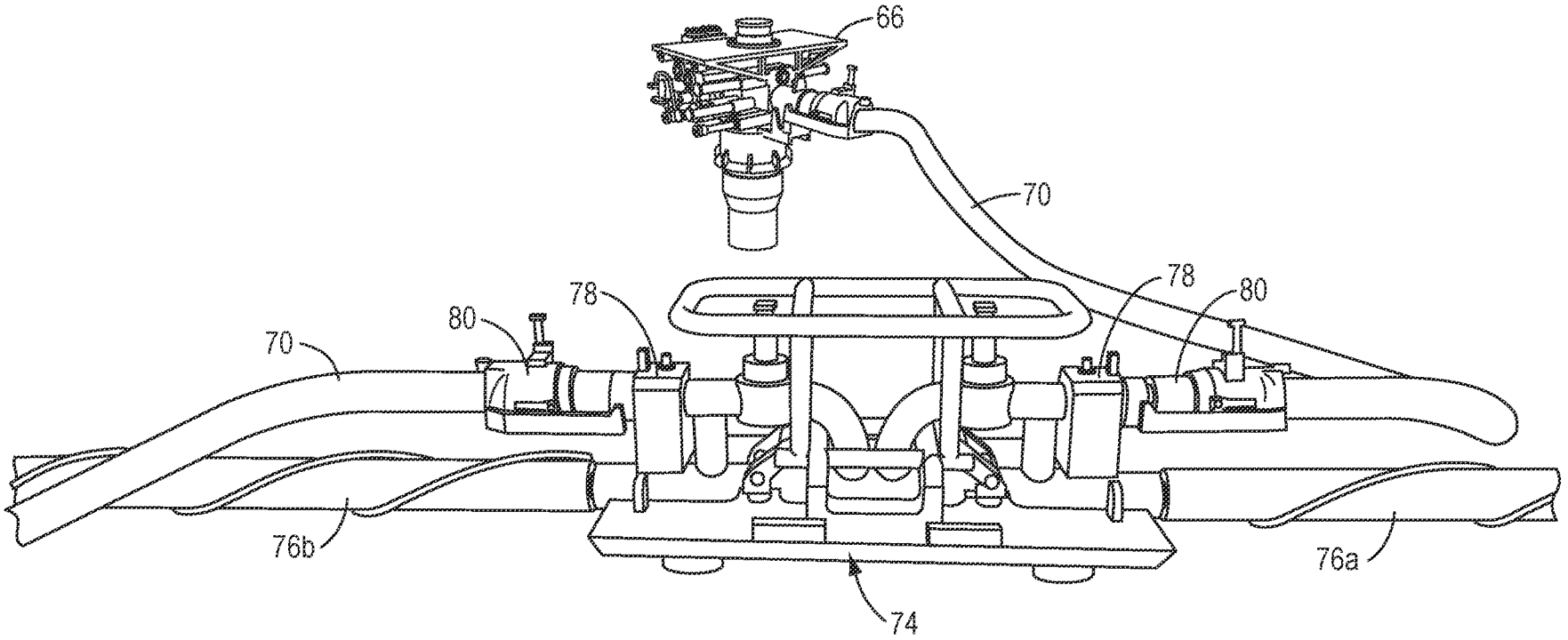
FIG. 8 is a representation of the tie-in module component of the subsea field shown in FIG. 2.

Instead of a manifold similar to the manifold 68, the trees 66 in the second sub-field 64 are connected to the flowline 76 through the tie-in modules 72, 74. In the embodiment of the disclosure shown in the drawings, each tie-in module 72, 74 is configured to connect two trees 66 to the flowline 76. As shown in FIG. 8, for example, the second tie-in module 74 connects the flowline jumpers 70 from two trees 66 (only one of which is shown) to the first and second flowline extensions 76*a*, 76*b*. The second tie-in module 74 thus includes four multibore hubs 78 to which corresponding connectors 80 on the ends of the flowline jumpers 70 and the flowline extensions 76*a*, 76*b* are connected. The first tie-in module 72 likewise includes four multibore hubs 78 to which corresponding connectors 80 on the ends of the flowline 76, the first flowline extension 76*a* and the flowline jumpers 70 from the remaining two trees 66 are connected. The multibore hubs 78 and the end connectors 80 may be similar to the multibore hub 78 and end connector 80 described above. An example of a tie-in module which is suitable for use in the present disclosure is an in-line manifold, such as the pipeline in-line manifold ("PLIM") provided by Forsys Subsea of London, UK. The PLIM manifold is described in UK Patent Application No. GB1605738.2 filed on Apr. 4, 2016, which is hereby incorporated herein by reference.

From the foregoing description it should be apparent that, in accordance with one embodiment of the disclosure, the hydraulic and/or electrical power, control and/or data lines in the trees 66 are connected to corresponding ones of the umbilical lines in the flowline 76 through the manifolds 68, 72, 74 and the flowline extensions 76*a*, 76*b*. For example, the hydraulic and/or electrical power, control and/or data lines in the two right-most trees 66 (as viewed in FIG. 2) of the second sub-field 64 are connected to corresponding ones of the umbilical lines in the flowline 76 through the first tie-in module 72; the umbilical lines in the first flowline extension 76*a* are connected to corresponding ones of the umbilical lines in the flowline 76 through the first tie-in module 72; the hydraulic and/or electrical power, control and/or data lines in the remaining two trees 66 of the second sub-field 64 are connected to corresponding ones of the umbilical lines in the first flowline extension 76*a* through the second tie-in module 74; the umbilical lines in the second flowline extension 76*b* are connected to corresponding ones of the umbilical lines in the first flowline extension 76*a* through the second tie-in module 74; and the hydraulic and/or electrical power, control and/or data lines in the trees 66 of the first sub-field 62 are connected to corresponding ones of the umbilical lines in the second flowline extension 76*b* through the manifold 68.

It should be recognized that, while the present disclosure has been presented with reference to certain embodiments, those skilled in the art may develop a wide variation of structural and operational details without departing from the principles of the disclosure. For example, the various elements shown in the different embodiments may be combined in a manner not illustrated above. Therefore, the following claims are to be construed to cover all equivalents falling within the true scope and spirit of the disclosure.

What is claimed is:

1. A subsea hydrocarbon production field comprising:
- a number of first subsea christmas trees;
- a first manifold; and
- a number of first flexible flowline jumpers, each of which is connected between the first manifold and a corresponding first tree;
- wherein each first flowline jumper comprises a first flow conduit and a number of first umbilical lines; and
- wherein each first flowline jumper comprises a first end which is removably connected to a corresponding first tree by a first multibore hub and connector arrangement and a second end which is removably connected to the first manifold by a second multibore hub and connector arrangement.

2. The subsea hydrocarbon production field of claim 1, further comprising:
- a first flowline which is connected to the first manifold, the first flowline comprising a second flow conduit and a number of second umbilical lines;
- wherein the first flow conduits are connected through the first manifold to the second flow conduit and the first umbilical lines are connected through the first manifold to corresponding ones of the second umbilical lines.

3. The subsea hydrocarbon production field of claim 2, wherein the first flowline jumpers and/or the first flowline comprise means for heating a fluid in the respective first and second flow conduits.

4. The subsea hydrocarbon production field of claim 2, further comprising:
- a number of second subsea christmas trees;
- a second manifold;
- a number of second flexible flowline jumpers, each of which is connected between the second manifold and a corresponding second tree, and each of which comprises a third flow conduit and a number of third umbilical lines; and
- a second flowline which is connected between the first and second manifolds, the second flowline comprising a fourth flow conduit and a number of fourth umbilical lines;
- wherein the fourth flow conduit is connected through the first manifold to the second flow conduit and the fourth umbilical lines are connected through the first manifold to corresponding ones of the second umbilical lines; and
- wherein the third flow conduits are connected through the second manifold to the fourth flow conduit and the third umbilical lines are connected through the second manifold to corresponding ones of the fourth umbilical lines.

5. The subsea hydrocarbon production field of claim 4, wherein the first and second flowlines comprise respective sections of a single flowline.

6. The subsea hydrocarbon production field of claim 4, wherein the first flowline jumpers and/or the first flowline and/or the second flowline jumpers and/or the second flowline comprise means for heating a fluid in the respective first, second, third and fourth flow conduits.

7. The subsea hydrocarbon production field of claim 4, further comprising:
- a number of third subsea christmas trees;
- a third manifold;
- a number of third flexible flowline jumpers, each of which is connected between the third manifold and a corresponding third tree, and each of which comprises a fifth flow conduit and a number of fifth umbilical lines; and a third flowline which is connected between the second and third manifolds, the third flowline comprising a sixth flow conduit and a number of sixth umbilical lines;

wherein the sixth flow conduit is connected through the second manifold to the fourth flow conduit and the sixth umbilical lines are connected through the second manifold to corresponding ones of the fourth umbilical lines; and wherein the fifth flow conduits are connected through the third manifold to the sixth flow conduit and the fifth umbilical lines are connected through the third manifold to corresponding ones of the sixth umbilical lines.

8. The subsea hydrocarbon production field of claim 7, wherein the first, second and third flowlines comprise respective sections of a single flowline.

9. The subsea hydrocarbon production field of claim 7, wherein the first flowline jumpers and/or the first flowline and/or the second flowline jumpers and/or the second flowline and/or the third flowline jumpers and/or the third flowline comprise means for heating a fluid in the respective first, second, third, fourth, fifth and sixth flow conduits.

10. The subsea hydrocarbon production field of claim 1, 4 or 7, wherein at least one of the first manifold, the second manifold and the third manifold comprises a pipeline in-line manifold.

11. The subsea hydrocarbon production field of claim 1, wherein the first multibore hub and connector arrangement comprises a first multibore hub which forms part of the first tree and a first end connector which forms part of the first end of the first flowline jumper, wherein the second multibore hub and connector arrangement comprises a second multibore hub which forms part of the first manifold and a second end connector which forms part of the second end of the first flowline jumper, and wherein the first and second end connectors are releasably connectable to the first and second multibore hubs, respectively.

12. The subsea hydrocarbon production field of claim 11, wherein each of the first and second end connectors incudes a respective flowline bore which is connected to the first flow conduit in the first flowline jumper and a number of respective end line connectors which are each connected to a corresponding first umbilical line in the first flowline jumper.

13. The subsea hydrocarbon production field of claim 12:

wherein each first tree comprises a tree production bore and a number of tree transmission lines;

wherein the first multibore hub comprises a tree hub production bore which is connected to the tree production bore and a number of tree hub line connectors which are each connected to a corresponding tree transmission line;

wherein each end line connector of the first end connector is configured to be releasably connected to a corresponding tree hub line connector; and wherein when the first end connector is connected to the first multibore hub, the first flow conduit is connected to the tree production bore through the tree hub production bore and the first umbilical lines are connected to corresponding tree transmission lines through the end line connectors and the tree hub line connectors.

14. The subsea hydrocarbon production field of claim 13:

wherein each first manifold comprises a manifold production bore and a number of manifold transmission lines;

wherein the second multibore hub comprises a manifold hub production bore which is connected to the manifold production bore and a number of manifold hub line connectors which are each connected to a corresponding manifold transmission line;

wherein each end line connector of the second end connector is configured to be releasably connected to a corresponding manifold hub line connector; and wherein when the second end connector is connected to the second multibore hub, the first flow conduit is connected to the manifold production bore through the manifold hub production bore and the first umbilical lines are connected to corresponding hub transmission lines through the end line connectors and the manifold hub line connectors.

15. The subsea hydrocarbon production field of claim 14, wherein the end line connectors, the tree hub line connectors and the manifold hub line connectors comprise wetmate connectors.

16. A subsea hydrocarbon production field comprising:

a number of first subsea christmas trees;

a first manifold;

a number of first flexible flowline jumpers, each of which is connected between the first manifold and a corresponding first tree, and each of which comprises a first flow conduit and a number of first umbilical lines;

a first flowline which is connected to the first manifold, the first flowline comprising a second flow conduit and a number of second umbilical lines;

wherein the first flow conduits are connected through the first manifold to the second flow conduit and the first umbilical lines are connected through the first manifold to corresponding ones of the second umbilical lines;

a number of second subsea christmas trees;

a second manifold;

a number of second flexible flowline jumpers, each of which is connected between the second manifold and a corresponding second tree, and each of which comprises a third flow conduit and a number of third umbilical lines; and a second flowline which is connected between the first and second manifolds, the second flowline comprising a fourth flow conduit and a number of fourth umbilical lines;

wherein the fourth flow conduit is connected through the first manifold to the second flow conduit and the fourth umbilical lines are connected through the first manifold to corresponding ones of the second umbilical lines; and wherein the third flow conduits are connected through the second manifold to the fourth flow conduit and the third umbilical lines are connected through the second manifold to corresponding ones of the fourth umbilical lines.

17. The subsea hydrocarbon production field of claim 16, further comprising:

a number of third subsea christmas trees;

a third manifold;

a number of third flexible flowline jumpers, each of which is connected between the third manifold and a corresponding third tree, and each of which comprises a fifth flow conduit and a number of fifth umbilical lines; and a third flowline which is connected between the second and third manifolds, the third flowline comprising a sixth flow conduit and a number of sixth umbilical lines;

wherein the sixth flow conduit is connected through the second manifold to the fourth flow conduit and the sixth umbilical lines are connected through the second manifold to corresponding ones of the fourth umbilical lines; and wherein the fifth flow conduits are connected through the third manifold to the sixth flow conduit and the fifth umbilical lines are connected through the third manifold to corresponding ones of the sixth umbilical lines.

18. The subsea hydrocarbon production field of claim 16, wherein at least one of said first and second manifolds comprises a pipeline in-line manifold.

* * * * *